US006077145A

United States Patent [19]

Ma

[11] Patent Number: 6,077,145

[45] Date of Patent: Jun. 20, 2000

[54] YO-YO FOR PERFORMING TRICKS

[75] Inventor: Chak Kwong Ma, Hong Kong, The Hong Kong Special Administrative Region of the People's Republic of China

[73] Assignee: Gealex Toys Manufacturing Co., Ltd., Aberdeen, The Hong Kong Special Administrative Region of the People's Republic of China

[21] Appl. No.: 09/226,953

[22] Filed: Jan. 8, 1999

[30] Foreign Application Priority Data

Jul. 13, 1998 [GB] United Kingdom ..... 9815198

[51] Int. Cl.[7] ..... A63H 1/30

[52] U.S. Cl. ..... 446/250; 446/247

[58] Field of Search ..... 446/228, 233, 446/236, 247, 248, 249, 250, 262

[56] References Cited

U.S. PATENT DOCUMENTS

| | | | |
|---|---|---|---|
| 737,431 | 8/1903 | Marx | 446/262 |
| 1,949,858 | 3/1934 | Brown | 446/250 |
| 2,773,328 | 12/1956 | Fraenkel et al. | 446/250 |
| 3,287,846 | 11/1966 | Frangos | 446/250 |
| 5,184,972 | 2/1993 | Tomberlin | 446/249 |
| 5,356,328 | 10/1994 | Ho | 446/250 |
| 5,389,029 | 2/1995 | McAvoy et al. | 446/250 |
| 5,769,686 | 6/1998 | Duncan et al. | 446/250 |
| 5,961,366 | 10/1999 | Wei | 446/250 |

*Primary Examiner*—Sam Rimell

*Attorney, Agent, or Firm*—Abelman, Frayne & Schwab

[57] ABSTRACT

A yo-yo is disclosed as including two body-halves which are spaced-apart from each other, and are connected to each other by an axle, in which one of the body-halves includes a spindle which is movable between a first position in which it is received wholly within the body-half, and a second position in which at least part of the spindle extends into the space between the body halves.

15 Claims, 5 Drawing Sheets

YO-YO FOR PERFORMING TRICKS

This invention relates to a yo-yo and, in particular, a yo-yo which comprises an automatic-return mechanism.

It is well known that a lot of tricks can be played with a yo-yo. Many such tricks depend on the ability of the yo-yo to spin freely at the end of its string, which is referred to as "sleeping". However, for beginners, it may be a problem for them to retrieve the yo-yo after "sleeping". The yo-yo will then slow down its spinning and eventually stop. It will then be necessary to wind the string around the spool or axle of the yo-yo again. Winding the string around the spool or axle may in itself pose a problem to a beginner, especially if the circumferential surface of the spool or axle is very smooth. It is therefore an object of the present invention to provide a yo-yo in which the aforesaid shortcomings are mitigated, or at least to provide a useful alternative to the public.

According to the present invention, there is provided a yo-yo comprising a first body member and a second body member spaced-apart from each other, and connected to each other via an axle member, wherein said first body member comprises a spindle member which is movable between a first position in which it is received substantially wholly within said first body member, and a second position in which at least part of said spindle member extends into the space between said first and second body members.

Advantageously, said axle member may be engageable with a string, and wherein when said spindle member is in said second position, said string may be windable around said spindle member and said axle member.

Suitably, wherein said spindle member may be in said first position when said yo-yo is spinning about its axis of rotation above a critical speed.

Conveniently, said spindle member may be carried by a stopping member which is movable substantially parallel to the axis of rotation of said yo-yo.

Said stopping member may advantageously be movable between a first position in which said spindle member is in its first position, and a second position in which said spindle member is in its second position.

Said stopping member may suitably be acted upon by first spring means which biases said stopping member towards its first position.

Said first body member may conveniently comprise at least one urging member which is movable to permit movement of said stopping member substantially parallel to the axis of rotation of said yo-yo.

Advantageously, said first body member may comprise a plurality of urging members.

Conveniently, said body member may comprise three urging members.

Suitably, each or said urging member may comprise a weight member.

Each or said urging member may advantageously be slidably movable towards and away from the axis of rotation of said yo-yo.

Each or said urging member may conveniently be biased by second spring means towards said axis of rotation of said yo-yo.

Suitably, when said yo-yo is substantially stationary or spinning below said critical speed, said urging member(s) may abut and act upon said stopping member to its second position.

Advantageously, when said yo-yo is spinning about its axis of rotation above said critical speed, said or each urging member may be out of contact with said stopping member, whereby said stopping member may be moved to its first position upon the biasing action of said first spring means.

An embodiment of the present invention will now be described by way of an example, and with reference to the accompanying drawings, in which.

Figure 1:
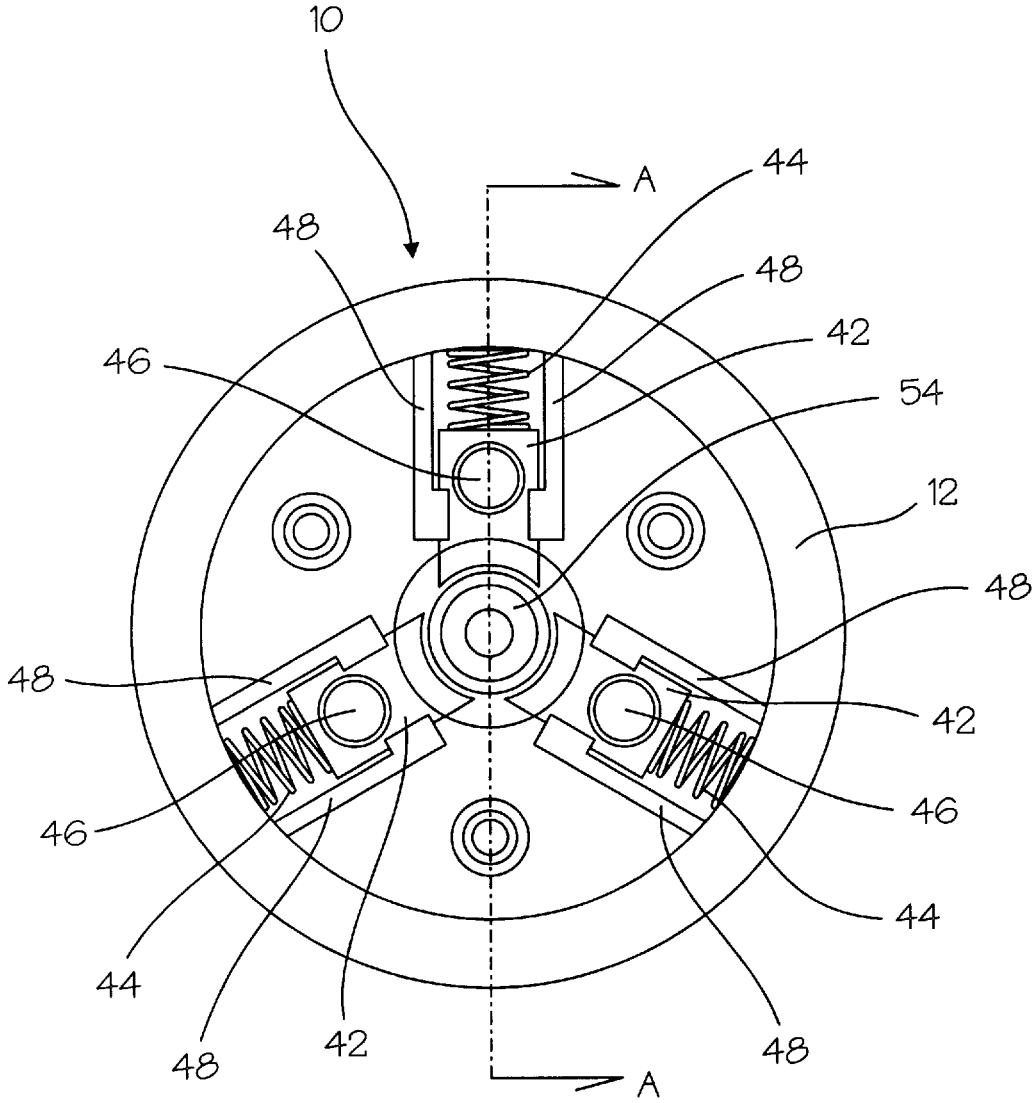
FIG. 1 shows a front view of a yo-yo according to the present invention.
Figure 2:
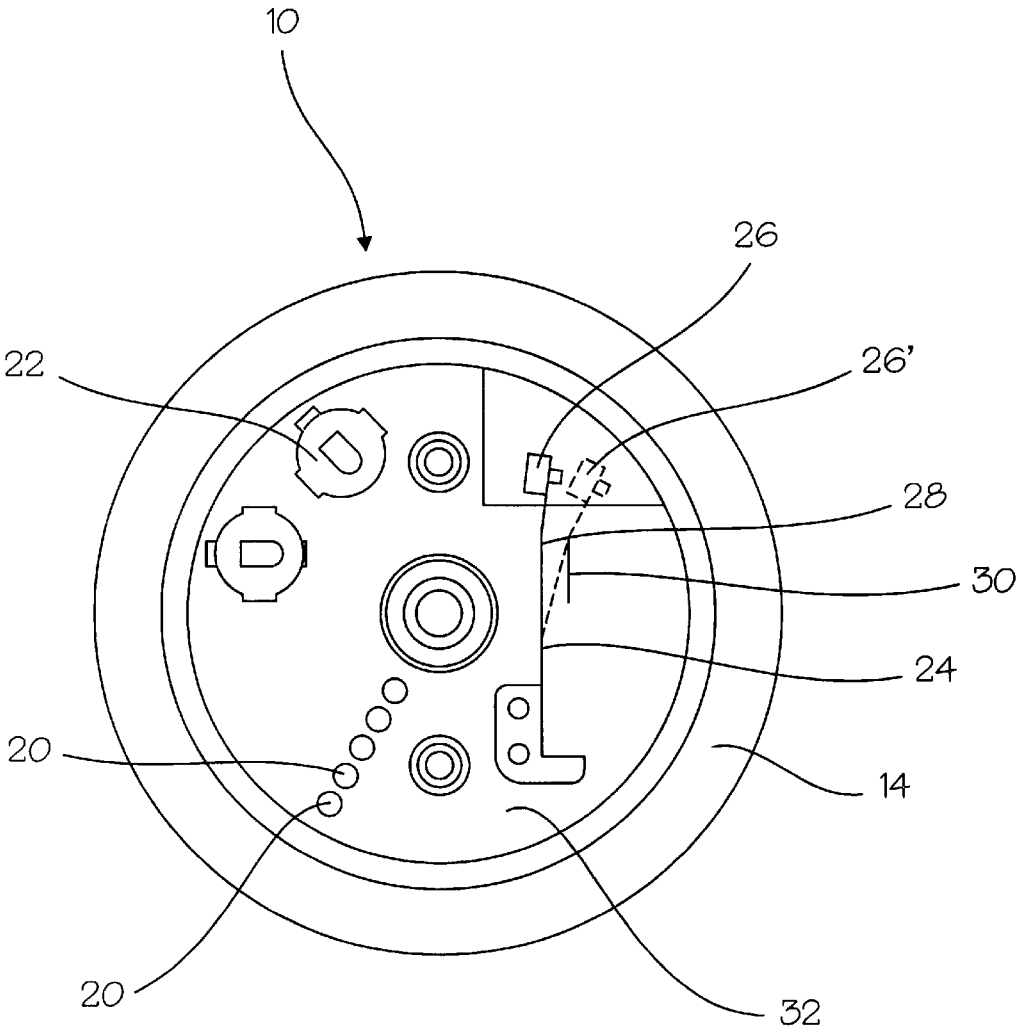
FIG. 2 shows a rear view of the yo-yo shown in FIG. 1.

A yo-yo in accordance with the present invention is shown in FIGS. 1 to 4 as generally designated as 10. The yo-yo 10 includes two body-halves 12, 14, which may be made of wood, metal or plastics materials. To each of the body-halves 12, 14 is secured a cover 16 which may also be made of wood, metal or plastics materials. In this example, both the body-halves 12, 14 and the covers 16 are made of plastics materials and, in particular, the covers 16 are transparent. If desired, it is possible to graphics designs may be provided on the covers 16 to enhance the aesthetic quality of the yo-yo 10. The covers 16 are secured to the body-halves 12, 14 by a number of screws 18.

To further enhance the aesthetic quality of the yo-yo 10, a row of LED's (light emitting diodes) 20 are provided in the body-half 14, which may be powered by a battery 22 via a switch 24. During spinning of the yo-yo 10, a weight 26 of the switch 24 will experience a centrifugal force, and thus move relative to the yo-yo 10 until it assumes the position shown as 26'. In this position, a metallic strip 28 will contact a plate 30 and electrical contact of the whole circuitry will be established, whereby the LED's 20 will light up. For ease of assembly, the LED's 20, battery 22, switch 24 and the plate 30 are all fixed on a printed circuit board 32. By way of such an arrangement, the LED's 20 will light up when the yo-yo 10 is spinning at a sufficiently high speed, and thus enhance the interest of playing.

Figure 3:
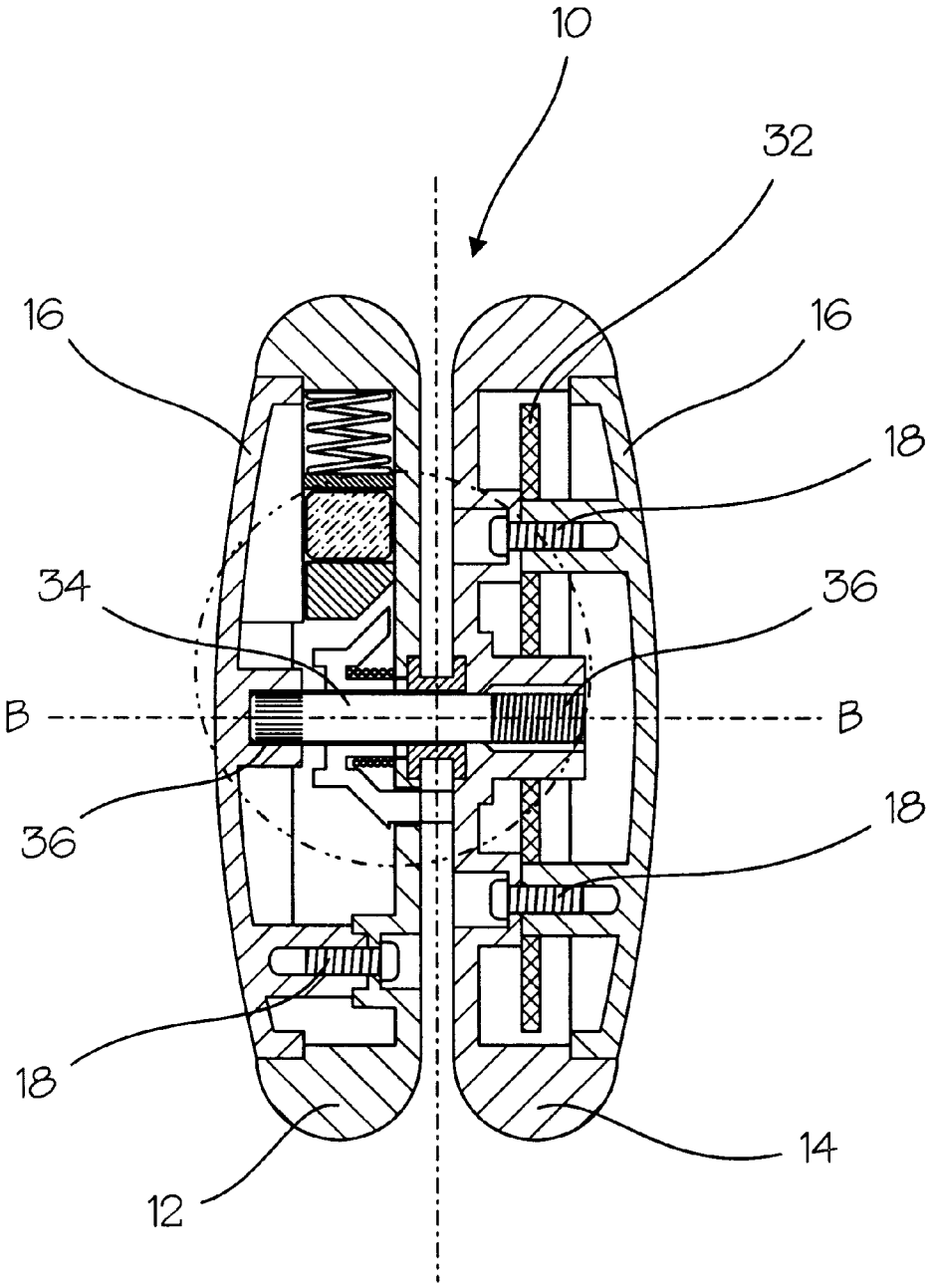
FIG. 3 is a sectional view of the yo-yo shown in FIG. 1 taken along the line A—A, with the spindle in the extended position.
Figure 4:
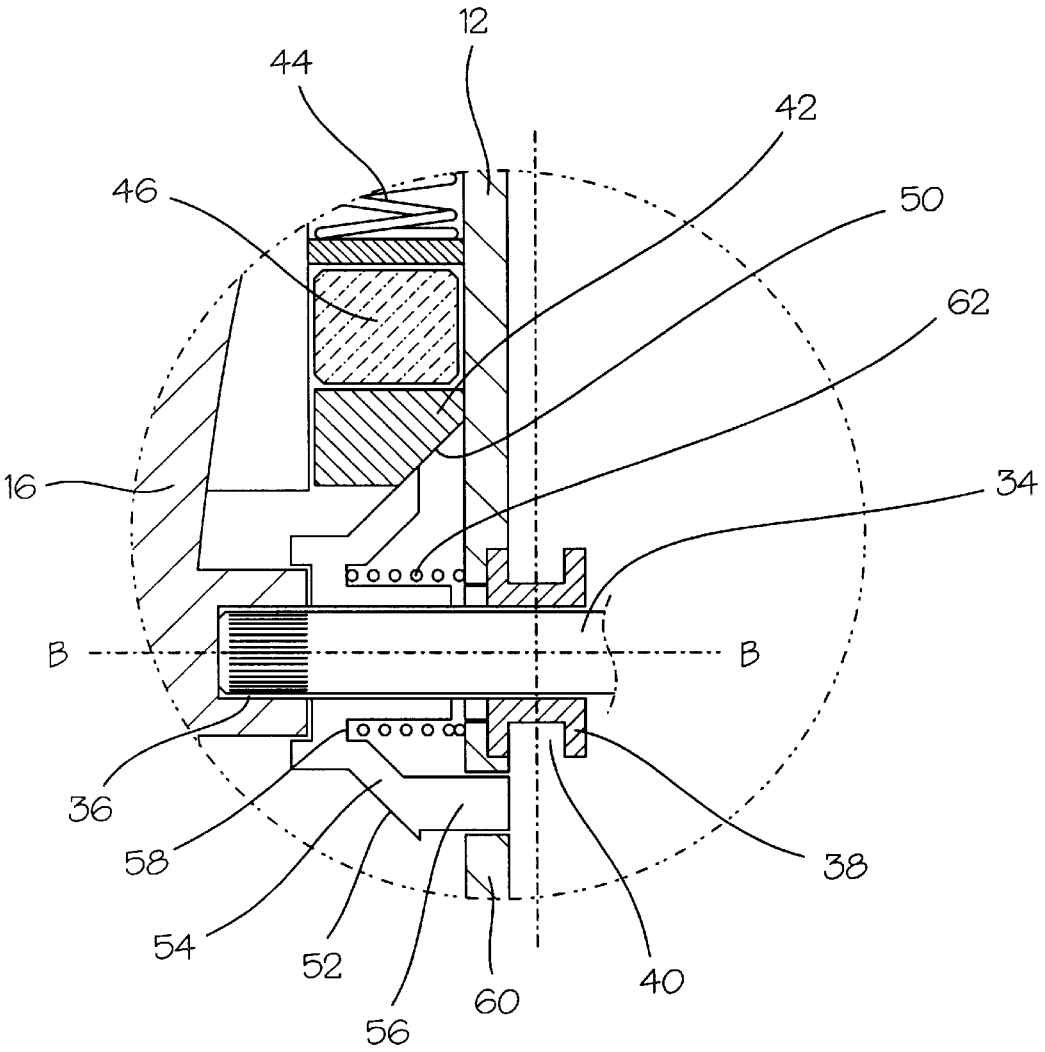
FIG. 4 is an enlarged view of the encircled part of the yo-yo shown in FIG. 3, with the spindle in the retracted position.

As shown in FIGS. 3 and 4, the body-halves 12, 14 are joined to each other via an axle 34. In particular, the axle 34 includes threaded ends 36 which are engaged respectively with the body-half 14 and the cover 16 of the body-half 12. A spool 38 having a hole is placed around the axle 34 and is freely rotatable thereabout. The spool 38 includes a circumferential groove 40 to which a string (not shown) may be attached. In conventionally known ways, the yo-yo 10 may be caused to rotate along its axis of rotation B—B, with the string wound or unwound around it, to perform a variety of tricks.

Turning to FIGS. 1, 4, 5A and 5B, it can be seen that contained in the body-half 12 are three jamming blocks 42, each of which being biased by a spring 44 towards the centre of the body-half 12. Each of the jamming blocks 42 includes a cavity for containing a weight 46, which may be made of such heavy metallic materials as lead or steel. Each of the jamming blocks 42 is reciprocate along a track formed by two guide plates 48.

When the yo-yo 10 is stationary (i.e. not spinning), or not spinning at a sufficiently high speed, the springs 44 will urge the jamming blocks 42 until they are in their innermost position, in which the respective beveled face 50 of the jamming blocks 42 will abut a correspondingly beveled surface 52 of a stopper 54. The stopper 54 is generally circular in shape and carries a pin 56. Between a cavity 58 of the stopper 54 and an inner side 60 of the body-half 12 is a spring 62, which biases the stopper 54 away from the spool 38. As the force exerted by the spring 62 is weaker than that exerted by the springs 44, when the yo-yo 10 is stationary (i.e. not spinning), or not spinning at a sufficiently high speed, the auto-return mechanism will assume the position as schematically shown in FIG. 5A. In this position, the pin 56 of the stopper 56 extends beyond the inner side 60 of the body-half 12, and into the cavity/space between the two body-halves 12, 14. A string (not shown) may then be easily wound around the pin 56 and the spool 38.

Figure 5B:
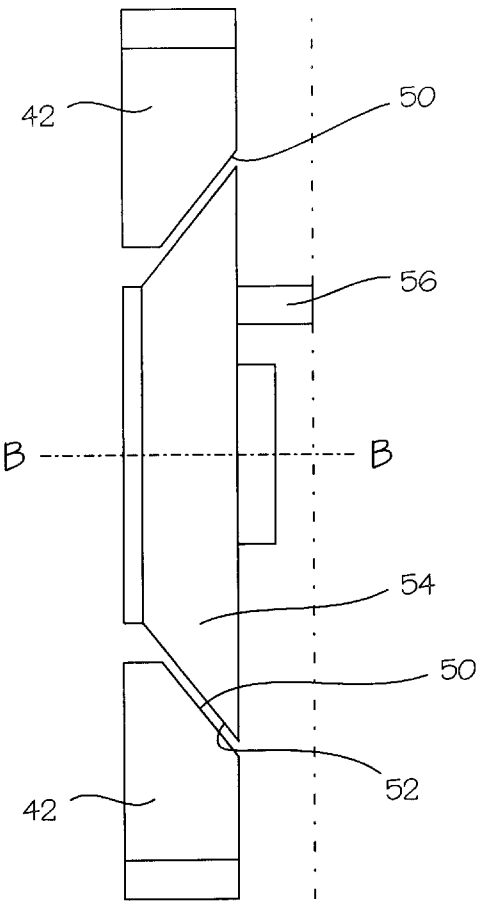
FIGS. 5A and 5B are schematic views showing the mode of operation of the automatic-return mechanism comprised in the yo-yo shown in FIG. 1.
Figure 5A:
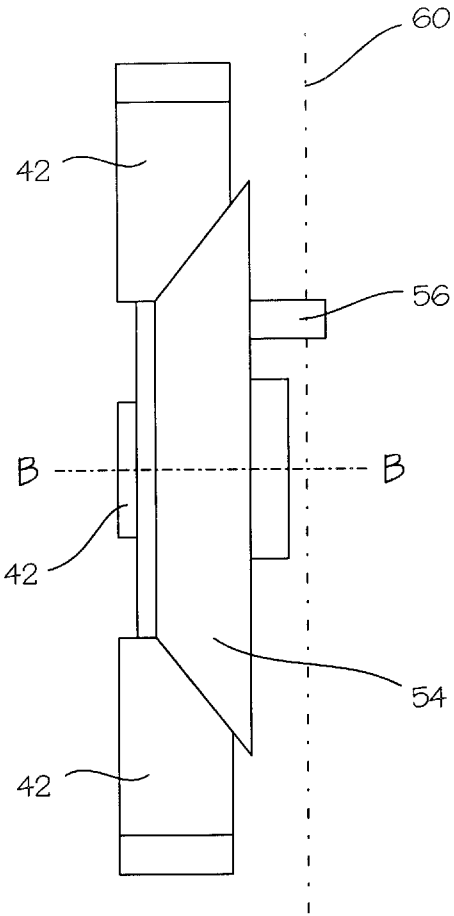

When the yo-yo 10 is spinning at or above a sufficiently high speed (the "critical speed"), the jamming blocks 42 (including the weights 46) will experience a centrifugal force, whereby they will move radially away from the centre of the body-half 21 until they are in the outermost position, and as shown in FIG. 5B. Once they are out of contact with the stopper 54, the spring 62 will move the stopper 54 to the position as shown in FIG. 5B. In this position, the pin 56 is contained wholly within the body-half 12. The yo-yo 10 may then spin freely ("sleep") at the end of the string.

When the yo-yo slows down its spinning action until its speed falls below the critical speed, the jamming blocks 42 will, upon the biasing action of the springs 44, move radially towards the centre of yo-yo 10 until the auto-return mechanism resumes its position as shown in FIG. 5A. Since this position is assumed while the yo-yo 10 is still spinning, the yo-yo 10 will have the string wound around itself and return to the player automatically.

It can be seen from the foregoing that the present invention provides a convenient and uncomplicated way for achieving an auto-return mechanism for a yo-yo. While such a feature may be more beneficial to a beginner, such should also be welcome by more advanced players who can devise more tricks with such a feature.

It should be understood that the above only describes an example whereby the present invention may be carried out, and that various modifications and/or alterations may be made thereto without departing from the spirit of this invention.

I claim:

1. A yo-yo comprising a first body member and a second body member spaced-apart from each other, and connected to each other via an axle member, wherein said first body member comprises a spindle member which is movable between a first position in which it is received substantially wholly within said first body member, and a second position in which at least part of said spindle member extends into the space between said first and second body members.

2. A yo-yo according to claim 1 wherein said axle member is engageable with a string, and wherein when said spindle member is in said second position, said string is windable around said spindle member and said axle member.

3. A yo-yo according to claim 1 wherein said spindle member is in said first position when said yo-yo is spinning about its axis of rotation above a critical speed.

4. A yo-yo according to claim 1 wherein said spindle member is carried by a stopping member which is movable substantially parallel to the axis of rotation of said yo-yo.

5. A yo-yo according to claim 4 wherein said stopping member is movable between a first position in which said spindle member is in its first position, and a second position in which said spindle member is in its second position.

6. A yo-yo according to claim 5 wherein said stopping member is acted upon by first spring means which biases said stopping member towards its first position.

7. A yo-yo according to claim 1 wherein said first body member comprises at least one urging member which is movable to permit movement of said stopping member substantially parallel to the axis of rotation of said yo-yo.

8. A yo-yo according to claim 7 wherein said first body member comprises a plurality of urging members.

9. A yo-yo according to claim 8 wherein said body member comprises three urging members.

10. A yo-yo according to claim 7 wherein each or said urging member comprises a weight member.

11. A yo-yo according to claim 7 wherein each or said urging member is slidably movable towards and away from the axis of rotation of said yo-yo.

12. A yo-yo according to claim 7 wherein each or said urging member is biased by second spring means towards said axis of rotation of said yo-yo.

13. A yo-yo according to claim 7 wherein said yo-yo is substantially stationary or spinning below said critical speed, each or said urging member abuts and acts upon said stopping member to its second position.

14. A yo-yo according to claim 7 wherein said yo-yo is spinning about its axis of rotation above said critical speed, said or each urging member is out of contact with said stopping member, whereby said stopping member is moved to its first position upon the biasing action of said first spring means.

15. A yo-yo according to claim 2 wherein said spindle member is in said first position when said yo-yo is spinning about its axis of rotation above a critical speed.

* * * * *